US010832605B2

(12) United States Patent
Rui et al.

(10) Patent No.: US 10,832,605 B2
(45) Date of Patent: Nov. 10, 2020

(54) INVERTER CIRCUIT AND DRIVING METHOD THEREOF, ARRAY SUBSTRATE AND DETECTION METHOD THEREOF, AND DISPLAY APPARATUS INCLUDING THE SAME

(71) Applicants: BOE Technology Group Co., Ltd., Beijing (CN); HEFEI XINSHENG OPTOELECTRONICS TECHNOLOGY CO., LTD, Anhui (CN)

(72) Inventors: Zhou Rui, Beijing (CN); Haipeng Yang, Beijing (CN); Ke Dai, Beijing (CN); Yong-Jun Yoon, Beijing (CN); Xiuli Si, Beijing (CN)

(73) Assignees: BOE TECHNOLOGY GROUP CO., LTD., Beijing (CN); HEFEI XINSHENG OPTOELECTRONICS TECHNOLOGY CO., LTD., Anhui (CN)

( * ) Notice: Subject to any disclaimer, the term of this patent is extended or adjusted under 35 U.S.C. 154(b) by 100 days.

(21) Appl. No.: 16/111,136

(22) Filed: Aug. 23, 2018

(65) Prior Publication Data

US 2019/0221145 A1 Jul. 18, 2019

(30) Foreign Application Priority Data

Jan. 18, 2018 (CN) ..... 2018 1 0048648

(51) Int. Cl.
*G09G 3/36* (2006.01)
*G09G 3/30* (2006.01)
(Continued)

(52) U.S. Cl.
CPC ..... *G09G 3/006* (2013.01); *G09G 3/20* (2013.01); *G09G 3/30* (2013.01); *G09G 3/3677* (2013.01); *G09G 2310/0267* (2013.01)

(58) Field of Classification Search
CPC ..... G09G 3/3677; G09G 2310/0267
See application file for complete search history.

(56) References Cited

U.S. PATENT DOCUMENTS 5,526,216 A * 6/1996 Konrad ..... H03K 17/0828 327/310
5,831,472 A * 11/1998 Wang ..... H03K 19/01721 327/543
(Continued)

FOREIGN PATENT DOCUMENTS

CN 2474403 Y 1/2002
CN 1801264 A 7/2006
(Continued)

OTHER PUBLICATIONS

Office Action issued in corresponding Chinese Patent Application No. 201810048648.4, dated Nov. 29, 2019.

*Primary Examiner* — William Boddie
*Assistant Examiner* — Bipin Gyawali
(74) *Attorney, Agent, or Firm* — McDermott Will & Emery LLP

(57) ABSTRACT

Various embodiments of the present disclosure provide an inverter circuit, a driving method, an array substrate, a detecting method, and a display apparatus, which may enable a simple structure by incorporating a switch transistor with a resistor. The simple structure is configured to make the levels of a signal at an outputting terminal of the inverter circuit and a signal at an inputting terminal of the inverter circuit being opposite.

14 Claims, 4 Drawing Sheets

(51) Int. Cl.
*G09G 3/00* (2006.01)
*G09G 3/20* (2006.01)

(56) References Cited

U.S. PATENT DOCUMENTS 5,886,565 A * 3/1999 Yasui ..... G05F 1/575 327/530
6,034,566 A * 3/2000 Ohe ..... H03F 3/191 330/69
6,201,437 B1 * 3/2001 Kono ..... G05F 1/465 327/143
7,230,855 B2 * 6/2007 Chevallier ..... G11C 16/3404 365/185.03
7,518,602 B2 4/2009 Nozawa
7,626,868 B1 * 12/2009 Wang ..... G11C 11/5628 365/185.03
7,724,232 B2 * 5/2010 Moon ..... G11C 19/184 345/100
7,893,730 B2 * 2/2011 Jung ..... H03K 19/01852 327/108
7,902,844 B2 * 3/2011 Matsunaga ..... G01R 31/3004 324/713
8,379,790 B2 * 2/2013 Tobita ..... G11C 19/287 377/64
8,415,965 B2 * 4/2013 Cho ..... G09G 3/006 324/760.01
8,558,552 B2 * 10/2013 Chappell ..... H04B 3/46 324/534
9,214,224 B2 * 12/2015 Jeon ..... G11C 13/003
9,524,689 B2 * 12/2016 Dai ..... G11C 19/28
9,626,028 B2 * 4/2017 Li ..... G06F 3/0416
10,103,343 B2 * 10/2018 Fischer ..... H01L 27/283
10,224,253 B2 * 3/2019 Ko ..... H01L 27/1237
10,469,074 B2 * 11/2019 Kim ..... H03K 17/223
10,629,129 B2 * 4/2020 Xiao ..... G09G 3/3258
2009/0103361 A1 * 4/2009 Wang ..... G11C 11/5628 365/185.03
2010/0219853 A1 * 9/2010 Cho ..... G09G 3/006 324/760.01
2010/0237898 A1 * 9/2010 Kikuta ..... H02M 1/32 324/764.01
2018/0341153 A1 * 11/2018 Dong ..... G02F 1/1337
2019/0371422 A1 * 12/2019 Wang ..... G09G 3/3266

FOREIGN PATENT DOCUMENTS

CN 101021628 8/2007
CN 105161042 A * 12/2015
CN 105161042 A 12/2015
CN 107038984 A 8/2017
KR 20030095127 A 12/2003

* cited by examiner

INVERTER CIRCUIT AND DRIVING METHOD THEREOF, ARRAY SUBSTRATE AND DETECTION METHOD THEREOF, AND DISPLAY APPARATUS INCLUDING THE SAME

CROSS-REFERENCE TO RELATED APPLICATION(S)

This application claims priority to Chinese Patent Application No. 201810048648.4, filed on Jan. 18, 2018, entitled "INVERTER CIRCUIT AND DRIVING METHOD THEREOF, ARRAY SUBSTRATE AND DETECTION METHOD THEREOF, AND DISPLAY APPARATUS INCLUDING THE SAME," which is incorporated herein by reference in its entirety.

TECHNICAL FIELD

The present disclosure relates to a field of controlling circuits, and in particular, to an inverter circuit, a driving method, an array substrate, a detection method and a display apparatus.

BACKGROUND

An inverter circuit is a circuit that can invert the level of an input signal and output the inverted signal. The inverter circuit may be used in analog circuits, such as audio amplifier circuits, clock oscillator circuits, and the like. In a design of a Thin Film Transistor (TFT), the inverter circuit is generally has a complicated structure and a large footprint.

SUMMARY

Various embodiments of the present disclosure provide an inverter circuit comprising: a switching transistor, having a gate electrically coupled with an inputting terminal of the inverter circuit, a first electrode electrically coupled with a first reference signal terminal, and a second electrode electrically coupled with an outputting terminal of the inverter circuit; and a voltage dividing resistor, having a first electrode electrically coupled with the second electrode of the switching transistor, and a second electrode electrically coupled with a second reference signal terminal. For example, the switch transistor has an on-state resistance $r_{m1}$ of $$\frac{r_0}{r_{m1}} \geq 10^3,$$

wherein $r_0$ indicates a resistance of the voltage dividing resistor.

As another example, the switch transistor has an off-state resistance $r_{m2}$ of $$\frac{r_{m2}}{r_0} \geq 10^3,$$

wherein $r_0$ indicates a resistance of the voltage dividing resistor.

Various embodiments of the present disclosure provide a method of driving an inverter circuit of above embodiments, comprising: inputting a first level signal to the inputting terminal of the inverter circuit, so as to control the switch transistor to be turned on and enable the outputting terminal of the inverter circuit to output a second level signal, at a first stage; and inputting the second level signal to the inputting terminal of the inverter circuit, so as to control the switch transistor to be turned off and enable the outputting terminal of the inverter circuit to output the first level signal, at a second stage.

Various embodiments of the present disclosure further provide an array substrate, comprising: a gate driving circuit; a plurality of signal lines electrically coupled with the gate driving circuit, wherein each two of the plurality of signal lines which are configured to input signals with opposite levels are divided into one group; at least one inverter circuit, wherein the at least one inverter circuit is coupled with at least one group of signal lines respectively; wherein each of the at least one inverter circuit has an inputting terminal electrically coupled with a first signal line of a respective group of signal lines, and an outputting terminal electrically coupled with a second signal line of the respective group of signal lines; and wherein each of the at least one inverter circuit is the inverter circuit of above embodiments.

For example, each group of signal lines is associated with one inverter circuit.

As another example, the plurality of signal lines comprise clock signal lines.

As another example, the clock signal lines comprise at least six clock signal lines.

As another example, the plurality of signal lines comprise a first reference voltage signal line and a second reference voltage signal line, and wherein the first reference voltage signal line has a signal with an opposite level with the second reference voltage signal lines.

As another example, the inverter circuit is provided in a pre-cutting area of the array substrate.

Various embodiments of the present disclosure further provide a display apparatus comprising the array substrate of above embodiments.

For example, the array substrate is a panel area without a pre-cutting area.

Various embodiments of the present disclosure further provide a method of detecting the array substrate of above embodiments, comprising: connecting an external jig probe to at least one of the plurality of signal lines; inputting a test signal to the at least one signal line; wherein the at least one inverter circuit is coupled with at least one group of signal lines respectively, and the at least one signal line to which the external jig probe is connected is the signal line electrically coupled with the inputting terminal of the at least one inverter circuit.

For example, each group of signal lines is associated with one inverter circuit; wherein the connecting of the external jig probe to the at least one of the plurality of signal lines comprises: connecting the external jig probe to the signal line electrically coupled with the inputting terminal of each of the at least one inverter circuit, respectively.

As another example, the plurality of signal lines comprise clock signal lines; wherein the inputting of a test signal to the at least one signal line comprises inputting a clock signal to the at least one signal line.

As another example, the plurality of signal lines comprise a first reference voltage signal line and a second reference voltage signal line; wherein the inputting of a test signal to the at least one signal line comprises inputting a reference voltage signal to the at least one signal line.

DETAILED DESCRIPTION

In order to make objectives, solutions and advantages of the present disclosure more clearly, specific embodiments of an inverter circuit, a driving method, an array substrate, a detecting method and a display apparatus of the embodiments of the present disclosure will be described in detail below with reference to the accompanying drawings. The various embodiments described below are to be construed as illustrative only and not to limit the disclosure. The embodiments of the present disclosure and the features of the embodiments may be combined with each other without conflicting.

Figure 1:
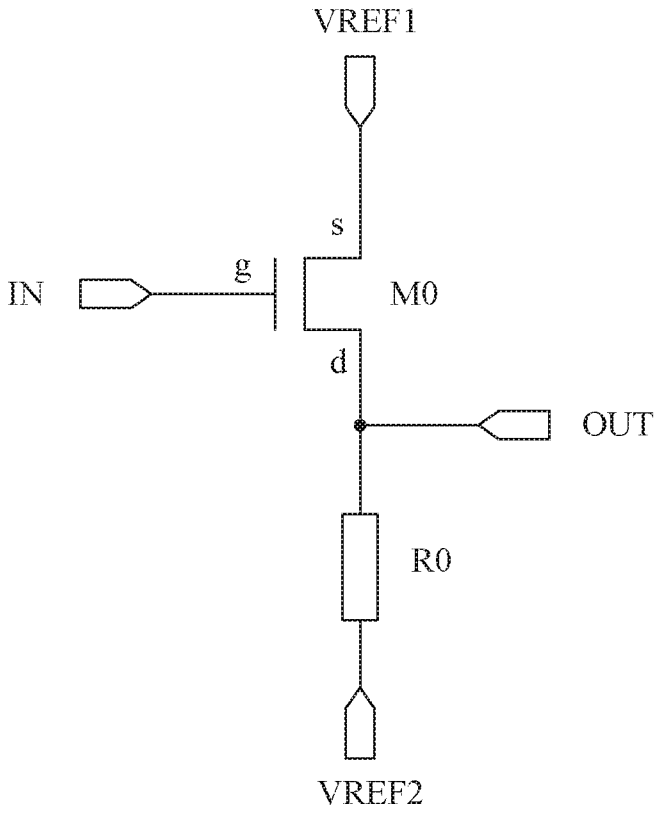
FIG. 1 shows a schematic structural diagram illustrating an inverter circuit according to various embodiments of the present disclosure.

As shown in FIG. 1, an inverter circuit according to various embodiments of the present disclosure may include a switch transistor M0 and a voltage dividing resistor R0. The switching transistor M0 has a gate (g) electrically coupled with an inputting terminal of the inverter circuit IN, a first electrode (s) electrically coupled with a first reference signal terminal VREF1, and a second electrode (d) electrically coupled with an outputting terminal of the inverter circuit OUT. The voltage dividing resistor R0 has a first electrode electrically coupled with the second electrode (d) of the switching transistor, and a second electrode electrically coupled with a second reference signal terminal VREF2.

According to various embodiments of the present disclosure, the inverter circuit only comprises one switch transistor and one resistor. By using such a simple structure, signal at the outputting terminal of the inverter circuit may be inverted to signal at the inputting terminal, which may reduce an occupied area and the cost.

For example, in the above-described inverter circuit according to various embodiments of the present disclosure, the switch transistor M0 will be turned on in response to the voltage difference Vgs between its gate (g) and its first electrode (s) being greater than the threshold voltage Vth of the switch transistor M0. That is, the switch transistor M0 is turned on when Vgs> Vth. At this time, the switch transistor M0 may have an on-state resistance $r_{m1}$. In addition, the switch transistor M0 will be turned off in response to the voltage difference Vgs between its gate (g) and its first electrode (s) being smaller than the threshold voltage Vth of the switch transistor M0. That is, the switch transistor M0 is turned off when Vgs<Vth. At this time, the switch transistor M0 may have an off-state resistance $r_{m2}$.

For example, in the above-described inverter circuit according to various embodiments of the present disclosure, the switch transistor the on-state resistance $r_{m1}$ of $$\frac{r_0}{r_{m1}} \geq 10^3,$$

wherein $r_0$ indicates a resistance of the voltage dividing resistor.

For example, in the above-described inverter circuit according to various embodiments of the present disclosure, the switch transistor has the off-state resistance $r_{m2}$ of $$\frac{r_{m2}}{r_0} \geq 10^3,$$

wherein $r_0$ indicates a resistance of the voltage dividing resistor.

The material of an active layer of a thin film transistor applied to a flat panel display may include silicon, such as amorphous silicon, polycrystalline silicon, microcrystalline silicon, or the like; or may be a metal oxide semiconductor material such as indium gallium zinc oxide (IGZO), indium zinc oxide (IZO), or the like, which is not limited herein. Since the cost of amorphous silicon is relatively low due to its capability of being deposited on various large substrates, amorphous silicon has been widely used. The material of the active layer of the switch transistor according to various embodiments of the present disclosure may be amorphous silicon. Certainly, the material of the active layer of the switch transistor may also be other semiconductor materials, which is not limited herein.

For example, the on-state resistance $r_{m1}$ of the switch transistor indicates the on-state resistance of the switch transistor when the channel of the active layer is of a unit aspect ratio. The off-state resistance $r_{m2}$ of the switch transistor indicates the off-state resistance of the switch transistor when the channel of the active layer is of a unit aspect ratio. For example, the voltage dividing resistor may have the resistance of $r_0=10^{10}\Omega$, the switch transistor may have the on-resistance of $r_{m1}=10^7\Omega$ and the off-state resistance of $r_{m2}=10^{13}\Omega$. Certainly, in practical implements, due to different implement environments of the inverter circuit, the specific values of $r_0$, $r_{m1}$, and $r_{m2}$ are also different. The specific values of $r_0$, $r_{m1}$, and $r_{m2}$ depend on the practical implement environment, which is not limited here.

For example, according to various embodiments of the present disclosure, signal at the inputting terminal of the inverter circuit may be a square wave signal, or a high level signal with a fixed voltage, or a low level signal with a fixed voltage, which is not limited here. In practical implements, the voltage of the high level signal and the voltage of the low level signal may be determined according to the specific implement environment, which is not limited herein.

For example, according to various embodiments of the present disclosure, the signal at the first reference signal terminal may be a low level signal, and the signal at the second reference signal terminal may be a high level signal. The specific voltage values of the signals depend on the actual implement environment, which is not limited herein.

For example, when the signal at the inputting terminal of the inverter circuit is a square wave signal, the voltage of the signal at the first reference signal terminal may be the same as the voltage of a low level in the square wave signal, and the voltage of the signal at the second reference signal terminal may be the same as the voltage of a high level in the square wave signal.

For example, as shown in FIG. 1, the switch transistor M0 may be an N-type transistor. In some embodiments, the switch transistor can also be a P-type transistor, which is not limited herein.

Figure 2:
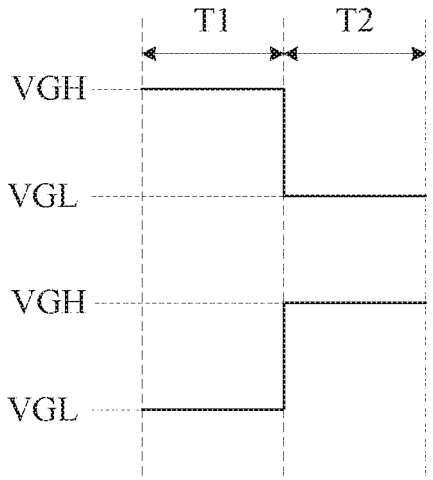
FIG. 2 shows a timing diagram of an inverter circuit according to various embodiments of the present disclosure.

For example, the gate of the above switch transistor may be used as a controlling electrode, and the first electrode and the second electrode may be used as a source/drain and a drain/source respectively, according to the type of the switch transistor and the signal at the inputting terminal, which is not limited herein The operation of the above-described inverter circuit according to various embodiments of the present disclosure will be described in detail below with reference to a timing diagram shown in FIG. 2. In particular, the description is made by assuming that the signal at the inputting terminal IN is a square wave signal, the high level signal at the inputting terminal IN has the voltage of VGH, the low level signal at the inputting terminal IN has the voltage of VGL, the signal at the first reference signal terminal VREF1 has the voltage of VGL, and the signal at the second reference signal terminal VREF2 has the voltage of VGH.

At the first stage T1, the signal at the inputting terminal IN is the high level signal, the gate (g) of the switch transistor M0 has the voltage of Vg=VGH, and the first electrode (s) of the switch transistor M0 has the voltage of Vs=VGL. Thus, Vgs=Vg−Vs=VGH−VGL, i.e. Vgs>Vth. At this time, the switch transistor M0 is turned on. Therefore, the outputting terminal OUT of the inverter circuit has the voltage of Vo satisfying $$V_o - VGL = (VGH - VGL)\frac{r_{m1}}{r_{m1} + r_0}.$$

Since $$\frac{r_0}{r_{m1}} \geq 10^3,$$

$V_o$−VGL≈(VGH−VGL)*$10^{-3}$. Since VGH can be set to 15~40V and VGL can be set to −11~0V in the practical implement, Vo−VGL is about 0.015~0.051V. Thus, it can be considered that Vo=VGL, that is, the voltage at the outputting terminal OUT can be made approximately the same as the voltage of the low level signal at the inputting terminal IN, thereby realizing an inversion of the high level signal at the inputting terminal IN.

At the second stage T2, the signal at the inputting terminal IN is the low level signal, the gate (g) of the switch transistor M0 has the voltage of Vg=VGL, and the first electrode (s) of the switch transistor M0 has the voltage of Vs=VGL. Thus, Vgs=Vg−Vs=0, i.e. Vgs<Vth. At this time, the switch transistor M0 is turned off. Therefore, the outputting terminal OUT of the inverter circuit has the voltage of Vo satisfying $$V_o - VGH = (VGL - VGH)\frac{r_0}{r_0 + r_{m2}}.$$

Since $$\frac{r_{m2}}{r_0} \geq 10^3,$$

$V_o$−VGH≈(VGL−VGH)*$10^{-3}$. Since VGH can be set to 15~40V and VGL can be set to −11~0V in the practical implement, Vo−VGL is about −0.051~−0.015V. Thus, it can be considered that Vo=VGL, that is, the voltage at the outputting terminal OUT can be made approximately the same as the voltage of the high level signal at the inputting terminal IN, thereby realizing an inversion of the low level signal at the inputting terminal IN.

Similarly, when the signal at the inputting terminal IN is a high level signal with a fixed voltage, the operation process can be referred to the first stage discussed above. When the signal at the inputting terminal IN is a low level signal with a fixed voltage, the operation process can be referred to the second stage discussed above.

It should be noted that the first stage and the second stage described above do not represent a rigorous execution order, and the two stages may be sequentially exchanged, and may be controlled according to actual needs.

Figure 3:
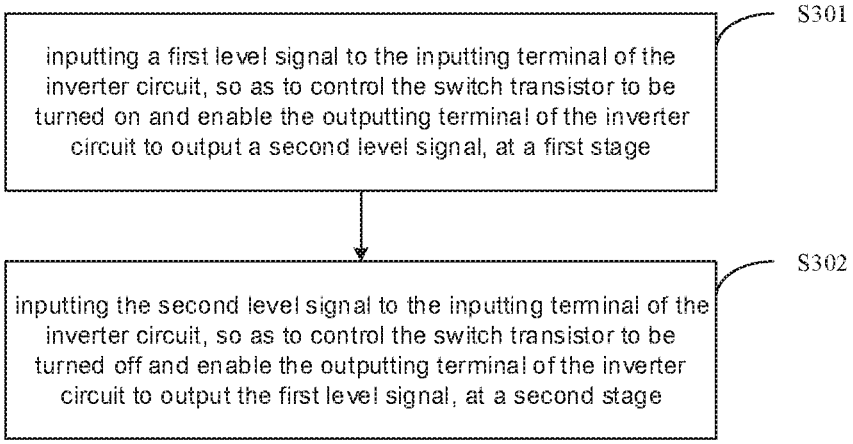
FIG. 3 shows a flow chart illustrating a driving method according to various embodiments of the present disclosure.

Embodiments of the present disclosure also provide a driving method of the above-described inverter circuit. FIG. 3 shows a flow chart illustrating a driving method according to various embodiments of the present disclosure. At S301, a first level signal is inputted to the inputting terminal of the inverter circuit, so as to control the switch transistor to be turned on and enable the outputting terminal of the inverter circuit to output a second level signal. At S302, the second level signal is inputted to the inputting terminal of the inverter circuit, so as to control the switch transistor to be turned off and enable the outputting terminal of the inverter circuit to output the first level signal.

With the above driving method of the various embodiments of the present disclosure, the signal at the outputting terminal of the inverter circuit may be inverted to the signal at the inputting terminal, which may reduce the occupied area and the cost. For example, the first level signal has a level opposite to the second level signal. In a specific implementation, the first level signal may be a high level signal, and the second level signal may be a low level signal. Alternatively, the first level signal may be a low level signal, and the second level signal is a high level signal, which is not limited herein and specifically depends on whether the switch transistor is an N type transistor or a P type transistor. Specifically, FIG. 2 shows a timing diagram by assuming that the switch transistor is an N-type transistor, the first level signal is a high level signal and the second level signal is a low level signal.

Figure 4:
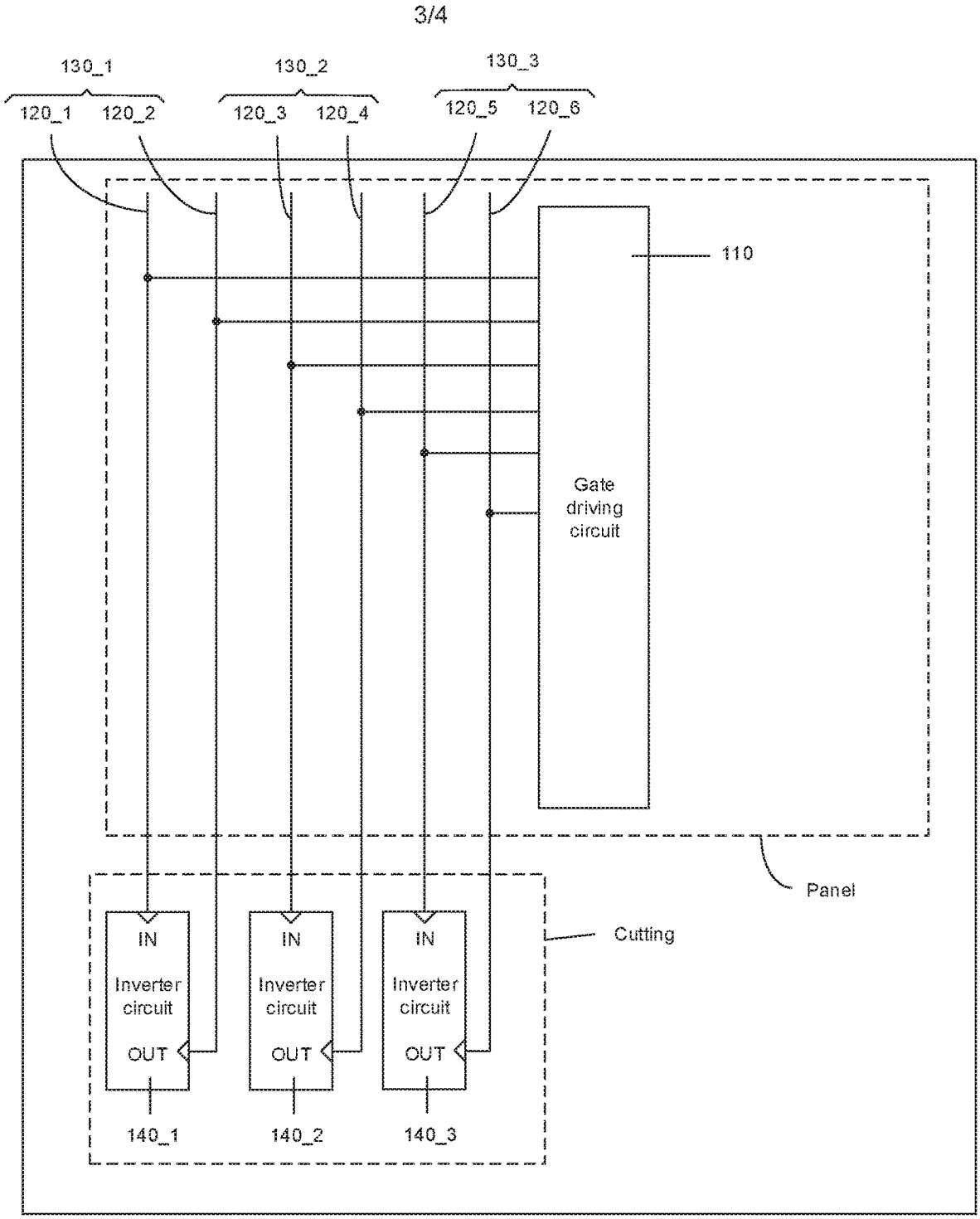
FIG. 4 shows a schematic structural view illustrating an array substrate according to various embodiments of the present disclosure.

The various embodiments of the present disclosure also provide an array substrate. As shown in FIG. 4, the array substrate according to various embodiments of the present disclosure may include: a gate driving circuit 110 and a plurality of signal lines 120_*m* electrically coupled with the gate driving circuit 110, wherein m=1, 2 . . . , M, and M is the number of signal lines. FIG. 4 takes M=6 as an example. Each two of the plurality of signal lines which are configured to input signals with opposite levels are divided into one group 130_*n*, wherein n=1, 2 . . . N and N is the number of groups of signal lines. FIG. 4 takes N=3 as an example.

The array substrate may further include at least one inverter circuit 140_*n* coupled with the at least one group of signal lines 130_*n* respectively. Each of the at least one inverter circuit 140_*n* has an inputting terminal IN electrically coupled with a first signal line of a respective group of signal lines 130_*n*, and an outputting terminal OUT electrically coupled with a second signal line of the respective group of signal lines 130_*n*; wherein each of the at least one inverter circuit 140_*n* is the inverter circuit of above embodiments.

According to various embodiments of the present disclosure, two signal lines which are configured to input signals with opposite levels are divided into one group, and the at least one inverter circuit is configured to be coupled with at least one group of signal lines respectively. Since the inverter circuit can enable the signal at the outputting terminal to be inverted to the signal at the inputting terminal, when inputting signals with opposite levels to the signal lines for driving a gate driving circuit, only the signal lines electrically coupled with the inputting terminals of the inverter circuit are inputted with signals by an external device, and the signal lines electrically coupled with the outputting terminals of the inverter circuit may output signals with an opposite level. Thus, no signals are required to be inputted into the signal lines electrically coupled with the outputting terminals of the inverter circuit by the external device, which may reduce the number of the signals required to be inputted into the gate driving circuit and lower the expectations on the external device. In addition, the inverter circuit has a simple structure, which may further reduce the occupied area and the cost.

As shown in FIG. 4, according to various embodiments of the present disclosure, each group of signal lines 130_*n* is associated with an inverter circuit 140_*n*. This can further reduce the number of signal input.

The gate driving circuit can be fabricated on the array substrate by a Gate Driver on Array (GOA) technique. After the array substrate is prepared, the array substrate may be tested to detect defective products in time. When detecting the gate driving circuit on the array substrate, it may be necessary to use a detecting device to input a plurality of clock signals (for example, 8 to 10 clock signals) and reference voltage signals to the gate driving circuit. The number of clock signals output by the detecting device may be fixed. If the number of clock signals required by the gate driving circuit is greater than the number of clock signals provided by the detecting device, the structure of the detecting device is generally improved to enable the output clock signals to satisfy the requirements. However, this will result in an increased cost. Alternatively, the array substrate is detected by removing some of the clock signals, but this will adversely affect the detection result of the array substrate.

In the above array substrate according to various embodiments of the present disclosure, the plurality of signal lines may comprise clock signal lines. Thus, two signal lines for inputting signals with opposite levels are coupled with one inverter circuit, thereby reducing the number of clock signals input by the detecting device and reducing the requirements on the detecting device. In addition, each group of signal lines is associated with an inverter circuit, and the detecting device can reduce the number of input clock signals by half, thereby avoiding an improvement in the structure of the detecting device and further improving the detection result.

The gate driving circuit can connect 2, 4, 6, 8, or 10 clock signal lines. In the above array substrate according to various embodiments of the present disclosure, the clock signal lines may be set to include at least six clock signal lines. The number of clock signal lines can be set to 6, 8, 10 and the like. In practical implements, the number of clock signal lines needs to be determined according to the practical implement environment, which is not limited herein.

When driving by the gate driving circuit, it may also necessary to input a high voltage reference signal VDD and a low voltage reference signal VSS, which are opposite in level. Further, the voltage of the high voltage reference signal VDD is the same as the voltage of the high level signal of the clock signal, and the voltage of the low voltage reference signal VSS is the same as the voltage of the low level signal of the clock signal. In the above array substrate according to various embodiment of the present disclosure, the signal lines may also include: a first reference voltage signal line and a second reference voltage signal line. The level of the signal on the first reference voltage signal line is opposite to the level of the signal on the second reference voltage signal line. For example, the first reference voltage signal line can be used to transmit the low voltage reference signal VSS, and the second reference voltage signal line can be used to transmit the high voltage reference signal VDD, which is not limited herein.

When detecting the gate driving circuit of the array substrate, since the detection time is short, there is no reliability requirement on the TFT characteristics in the circuit. Thus, the requirement on the accuracy of the input signal is low, so that the detection on whether the gate driving circuit being working in normal can be implemented by inputting a simple signal. When the array substrate is applied to a display apparatus, in a case that no strict requirement is made on the displaying effect, a signal can be input only to the signal lines electrically coupled with the inputting terminal of the inverter circuit, by a driving chip, so as to implement the display function. In the above array substrate according to various embodiments of the present disclosure, each of the signal lines, the gate driving circuit and the inverter circuit may be disposed in a panel area of the array substrate.

When a requirement on the display effect is high, as shown in FIG. 4, each of the signal lines 120_*m* and the gate driving circuit 110 are disposed in the panel area of the array substrate Panel, and the inverter circuit 140_*n* is disposed in a pre-cutting area of the array substrate. In this manner of cutting, the pre-cutting area can be removed when entering the rear end to form the display panel in the display apparatus, without affecting the display effect of the display apparatus.

It should be noted that the thickness and shape of each film in the above drawings do not intend to reflect a true proportion of the array substrate, and it is only to illustrate the disclosure.

Figure 6:
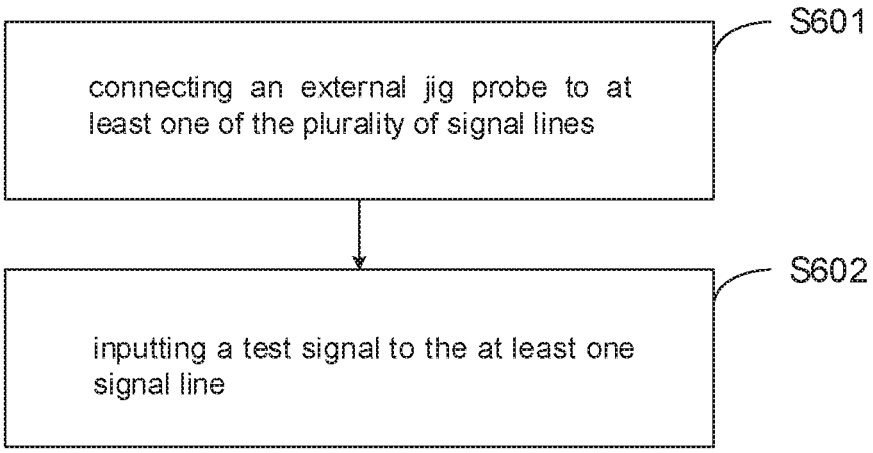
FIG. 6 shows a flowchart illustrating a method of detecting an array substrate according to various embodiments of the present disclosure.

Various embodiments of the present disclosure also provide a method of detecting an array substrate. As shown in FIG. 6, the detection method 60 can include the following steps. At S601, an external jig probe is connected to at least one of the plurality of signal lines. At S602, a test signal is inputted to the at least one signal line. When the at least one inverter circuit is coupled with at least one group of signal lines respectively, the at least one signal line to which the external jig probe is connected is the signal line electrically coupled with the inputting terminal of the at least one inverter circuit. Thus, each of the signal lines in the array substrate may be inputted with a corresponding test signal by using the external jig probe in the detecting device.

For example, each group of signal lines is associated with one inverter circuit. According to various embodiments of the present disclosure, the connecting of the external jig probe to the at least one of the plurality of signal lines comprises: connecting the external jig probe to the signal line electrically coupled with the inputting terminal of each of the at least one inverter circuit, respectively.

As another example, the plurality of signal lines comprise clock signal lines. According to various embodiments of the present disclosure, the inputting of a test signal to the at least one signal line comprises inputting a clock signal to the at least one signal line.

Figure 5:
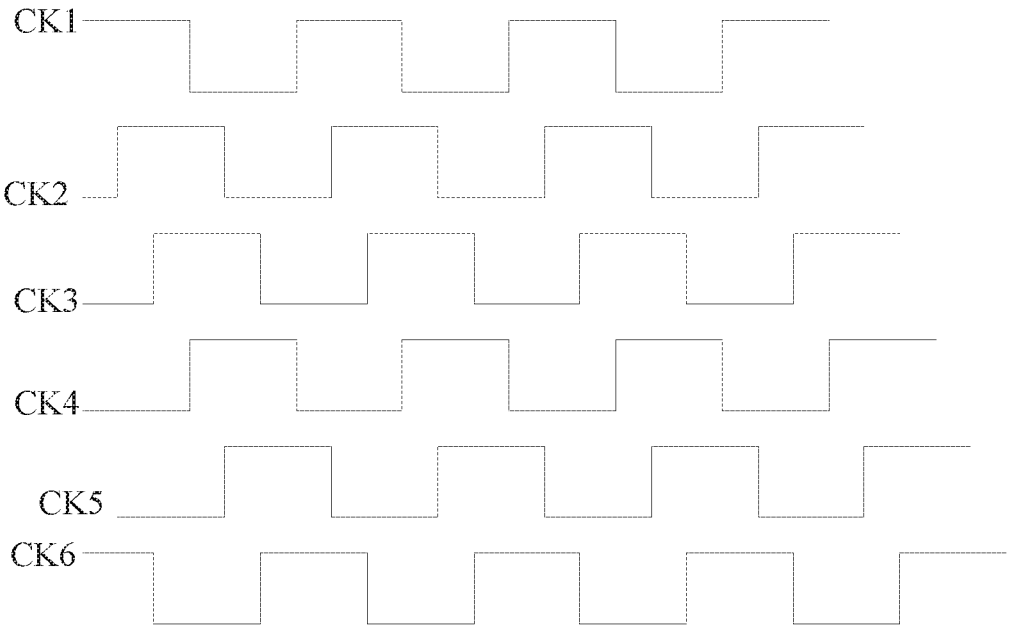
FIG. 5 shows a timing diagram of a signal inputted from an array substrate according to various embodiments of the present disclosure.

Taking the structure of the array substrate shown in FIG. 4 as an example, the process of the detection method will be described. The external jig probe is electrically coupled with the signal lines 120_1, 120_3, and 120_5 which are electrically coupled with the inputting terminals IN of the inverter circuits 140_*n*, respectively, so as to input the test clock signals CK1, CK2, CK3 shown in FIG. 5 to the signal lines 120_1, 120_3, and 120_5, respectively. Due to the inverter circuit 140_1, the inverter circuit 140_2, and the inverter circuit 140_3, the signal lines 120_2, 120_4, and 120_6 can be input with the clock signals CK4, CK5, and CK6 shown in FIG. 5. Thereby, it is possible to input a clock signal to the gate driving circuit 110.

The signal lines may include a first reference voltage signal line and a second reference voltage signal line. According to various embodiments of the present disclosure, the inputting of a test signal to the at least one signal line comprises inputting a reference voltage signal to the at least one signal line.

Various embodiments of the present disclosure also provide a display apparatus including an array substrate. For example, the array substrate in the display apparatus is a panel area without a pre-cutting area. In this way, the driving signal can be used to input a corresponding signal to the signal line in the array substrate. The display apparatus can include a display panel. The display panel may be a liquid crystal display panel or an electroluminescent display panel, which is not limited herein. The display apparatus can also be any product or component having a display function, such as a mobile phone, a tablet computer, a television, a display, a notebook computer, a digital photo frame, a navigator, and the like. Other indispensable components of the display apparatus should be understood by those skilled in the art, which are not described herein, nor should be construed as limiting the disclosure.

The inverter circuit, the driving method, the array substrate, the detecting method and the display apparatus provided by the various embodiments of the present disclosure can enable a simple structure by incorporating a switch transistor with a resistor, wherein the simple structure is configured to make the levels of the signal at the outputting terminal of the inverter circuit and the signal at the inputting terminal of the inverter circuit being opposite, reducing the footprint and production costs.

It will be apparent to those skilled in the art that various modifications and changes can be made in the present disclosure without departing from the spirit and scope of the disclosure. Thus, the present invention is intended to cover the modifications and the changes.

What is claimed is:

1. An inverter circuit comprising:

a switching transistor, having a gate electrically coupled with an inputting terminal of the inverter circuit, a first electrode electrically coupled with a first reference signal terminal, and a second electrode electrically coupled with an outputting terminal of the inverter circuit; and a voltage dividing resistor, having a first electrode directly coupled with the second electrode of the switching transistor, and a second electrode electrically coupled with a second reference signal terminal, wherein the switch transistor has an on-state resistance $r_{m1}$ of $$\frac{r_0}{r_{m1}} \geq 10^3,$$

wherein $r_0$ indicates a resistance of the voltage dividing resistor, and wherein the switch transistor has an off-state resistance $r_{m2}$ of $$\frac{r_{m2}}{r_0} \geq 10^3,$$

wherein $r_0$ indicates a resistance of the voltage dividing resistor.

2. A method of driving an inverter circuit of claim 1, comprising:

inputting a first level signal to the inputting terminal of the inverter circuit, so as to control the switch transistor to be turned on and enable the outputting terminal of the inverter circuit to output a second level signal, at a first stage; and inputting the second level signal to the inputting terminal of the inverter circuit, so as to control the switch transistor to be turned off and enable the outputting terminal of the inverter circuit to output the first level signal, at a second stage.

3. An array substrate, comprising:

a gate driving circuit;

a plurality of signal lines electrically coupled with the gate driving circuit, wherein each two of the plurality of signal lines which are configured to input signals with opposite levels are divided into one group;

at least one inverter circuit, wherein the at least one inverter circuit is coupled with at least one group of signal lines respectively, and wherein each of the at least one inverter circuit has an inputting terminal electrically coupled with a first signal line of a respective group of signal lines; and an outputting terminal electrically coupled with a second signal line of the respective group of signal lines, wherein each of the at least one inverter circuit is the inverter circuit of claim 1.

4. The array substrate of claim 3, wherein each group of signal lines is associated with one inverter circuit.

5. The array substrate of claim 3, wherein the plurality of signal lines comprise clock signal lines.

6. The array substrate of claim 5, wherein the clock signal lines comprise at least six clock signal lines.

7. The array substrate of claim 3, wherein the plurality of signal lines comprise a first reference voltage signal line and a second reference voltage signal line, and wherein the first reference voltage signal line has a signal with an opposite level with the second reference voltage signal lines.

8. The array substrate of claim 3, wherein the inverter circuit is provided in a pre-cutting area of the array substrate.

9. A display apparatus comprising the array substrate of claim 3.

10. The display apparatus of claim 9, wherein the array substrate is a panel area without a pre-cutting area.

11. A method of detecting the array substrate of claim 3, comprising:

connecting an external jig probe to at least one of the plurality of signal lines; and inputting a test signal to the at least one signal line, wherein the at least one inverter circuit is coupled with at least one group of signal lines respectively, and the at least one signal line to which the external jig probe is connected is the signal line electrically coupled with the inputting terminal of the at least one inverter circuit.

12. The method of claim 9, wherein each group of signal lines is associated with one inverter circuit, and wherein the connecting of the external jig probe to the at least one of the plurality of signal lines comprises:

connecting the external jig probe to the signal line electrically coupled with the inputting terminal of each of the at least one inverter circuit, respectively.

13. The method of claim 9, wherein the plurality of signal lines comprise clock signal lines, and wherein the inputting of a test signal to the at least one signal line comprises inputting a clock signal to the at least one signal line.

14. The method of claim 9, wherein the plurality of signal lines comprise a first reference voltage signal line and a second reference voltage signal line, and wherein the inputting of a test signal to the at least one signal line comprises inputting a reference voltage signal to the at least one signal line.

* * * * *